US007175300B1

(12) United States Patent
Medeiros

(10) Patent No.: US 7,175,300 B1
(45) Date of Patent: Feb. 13, 2007

(54) SIDE-ENTRY LAMPING FIXTURE

(75) Inventor: Andrew E. Medeiros, Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 89 days.

(21) Appl. No.: 10/840,773

(22) Filed: May 6, 2004

(51) Int. Cl.
*F21S 4/00* (2006.01)

(52) U.S. Cl. ..... 362/217; 362/221; 362/648

(58) Field of Classification Search ..... 362/220, 362/221, 217, 391, 362, 147, 648, 649, 640, 362/396, 260, 285, 372, 374
See application file for complete search history.

(56) References Cited

U.S. PATENT DOCUMENTS 4,498,126 A * 2/1985 Hernandez ..... 362/220
4,682,274 A * 7/1987 Freudenreich et al. ..... 362/519
4,883,434 A * 11/1989 Toyoshima ..... 439/619
5,010,455 A * 4/1991 Luallin et al. ..... 362/519
5,130,910 A * 7/1992 Engel ..... 362/217
5,541,826 A * 7/1996 Sandell et al. ..... 362/217
5,593,225 A * 1/1997 Safyan ..... 362/427
5,803,588 A * 9/1998 Costa ..... 362/223
6,170,967 B1 * 1/2001 Usher et al. ..... 362/394
6,457,848 B1 * 10/2002 Wolf et al. ..... 362/364

* cited by examiner

*Primary Examiner*—Renee Luebke
*Assistant Examiner*—Gunyoung T. Lee
(74) *Attorney, Agent, or Firm*—James E. Cole; Middleton Reutlinger

(57) ABSTRACT

The present invention provides a side-entry lamping fixture and cartridge, comprising a fixture having an upper fixture wall and a lower fixture wall, first and second sidewalls joining said upper and lower fixture walls and, at least one of the first and second sidewalls having a re-lamping aperture. The apparatus further comprises a lamping cartridge having a cover including a socket attached to the cover, a lamp in electrical communication with the socket and a fastening portion extending from the cover. The fixture and cartridge provide for a removable lamp which may be replaced without interfering with the fixture walls or a reflector therein, yet remain properly oriented when installed.

21 Claims, 4 Drawing Sheets

SIDE-ENTRY LAMPING FIXTURE

CROSS REFERENCES TO RELATED APPLICATIONS

None.

STATEMENT REGARDING FEDERALLY SPONSORED RESEARCH OR DEVELOPLMENT

None.

REFERENCE TO SEQUENTIAL LISTINGS, ETC.

None

BACKGROUND

1. Field of the Invention

The present invention comprises a high intensity discharge fixture for a track lighting system. More specifically, the present invention provides a high intensity discharge lamp and fixture having a side-entry lamping cartridge for a track lighting system.

2. Description of the Related Art

Applicant's present invention is related to a fixture for a track lighting system. Applicant's present invention is derived from an attempt to develop a fixture having a side-mounted lamp installation which is utilized with a track lighting system.

During development, applicant's side-mounted lamp exhibited two problems. First, the lamp or arc tube was prone to breakage during installation and removal of old lamps. Applicant's initial fixture was sized only slightly larger in length than an high intensity discharge arc tube or lamp. Otherwise stated the fixture did not provide for enough linear clearance between the socket and the reflector opposite the socket for the length of the arc tube and pins. As a result, when the lamp was initially installed in the fixture, the lamp had to be angled for installation into the socket and the lamp pins were often broken during installation into the socket. In addition, the lamp often struck the reflector which scratched the reflector and/or broke the lamp glass resulting in injury to the installer. On the other hand, when an expired lamp was removed from the socket the lack of linear clearance for the lamp and pin between the socket and opposed reflector wall also resulted in the lamp being removed at an angle and either breakage of the lamp pins or interference between the lamp and the reflector. This also resulted in scratches on the reflector and/or broken lamp glass.

Although Applicant could have enlarged the fixture size, Applicant did not desire to change the fixture in order to provide the added clearance for installation and removal of new and old lamps. Thus Applicant invented a novel structure to alleviate the above mentioned difficulties associated with a side mounted lamp and socket in a track lighting fixture.

SUMMARY OF THE INVENTION

With regard to the foregoing, the present invention eliminates the oversights, difficulties, and disadvantages of the prior art by providing a side-entry lamping fixture.

It is an object of the present invention to provide a track lighting fixture.

It is a further object of the present invention to provide a fixture having side mounted socket for a high intensity discharge arc tube or lamp.

It is still a further object of the present invention to provide a track lighting fixture having a lamping cartridge.

It is still an even further object of the present invention to a track lighting fixture having a lamping cartridge which is removable from a side of the fixture and allows for linear installation and removal of a lamp from a socket without interference with the reflector and fixture.

More specifically, the present invention provides a side-entry lamping fixture and cartridge, comprising a fixture having an upper fixture wall and a lower fixture wall, first and second sidewalls joining said upper and lower fixture walls and, at least one of the first and second sidewalls having a re-lamping aperture. The apparatus further comprises a lamping cartridge having a cover including a socket attached to the cover, a lamp in electrical communication with the socket and a fastening portion extending from the cover. The fixture and cartridge provide for a removable unit containing a fixture lamp which may be replaced without interfering with the fixture walls or a reflector therein, yet remain properly oriented when installed.

DETAILED DESCRIPTION

Given the foregoing deficiencies, it will be appreciated that a side-entry lamping cartridge is needed for use with a track lighting fixture which allows for removal of the lamp without damaging the lamp, fixture, or reflector therein.

Referring now in detail to the drawings, wherein like numerals indicate like elements through out the several views, there is shown in FIGS. 1–4 various aspects of a side-entry lamping fixture of the present invention. The side-entry lamping fixture of the present invention overcomes problems associated with the prior designs by utilizing a lamping cartridge which may be removed from a fixture sidewall in order to change lamps and precludes the need for a larger fixture for the preselected lamp size.

Figure 1:
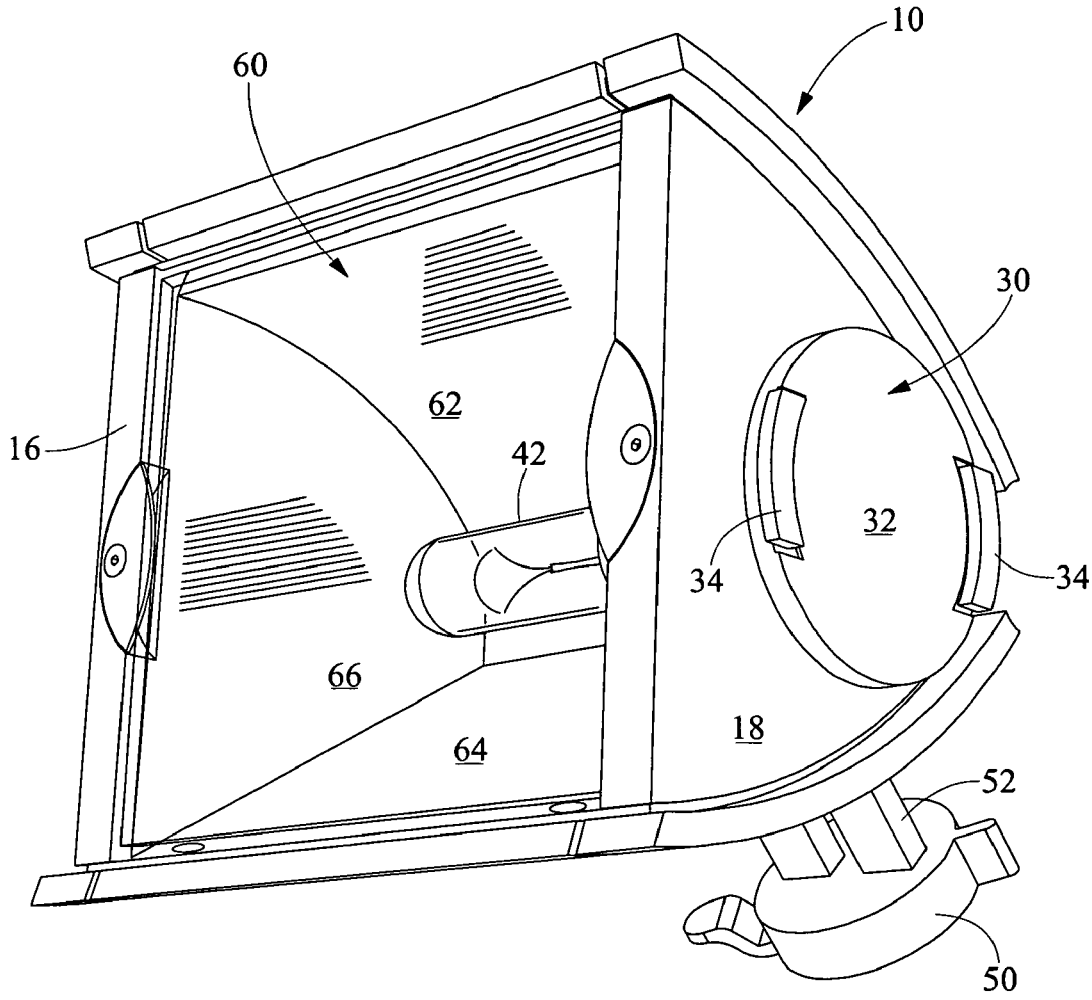
FIG. 1 is a perspective view of the side-entry lamping fixture of the present invention.

Referring initially to FIG. 1, a side-entry lamping fixture 10 is shown in a perspective view. The illustrative side-entry lamping fixture 10 of the present invention may be utilized on a tracklight system in order to provide a wall wash for a room or other habitable structure. The fixture 10 comprises an upper curvilinear wall 12 and a lower curvilinear wall 14 which are joined at the rear of fixture 10 by a substantially vertical wall 15. The side-entry lamping fixture 10 further comprises a first side wall 16 and a second side wall 18 which enclose the fixture 10 along side edges of the upper curvilinear wall 12 and lower curvilinear wall 14 and in combination therewith define the fixture 10 having an interior cavity as well as an opening in a front portion of the fixture 10 for positioning of a lens 25.

Figure 2:
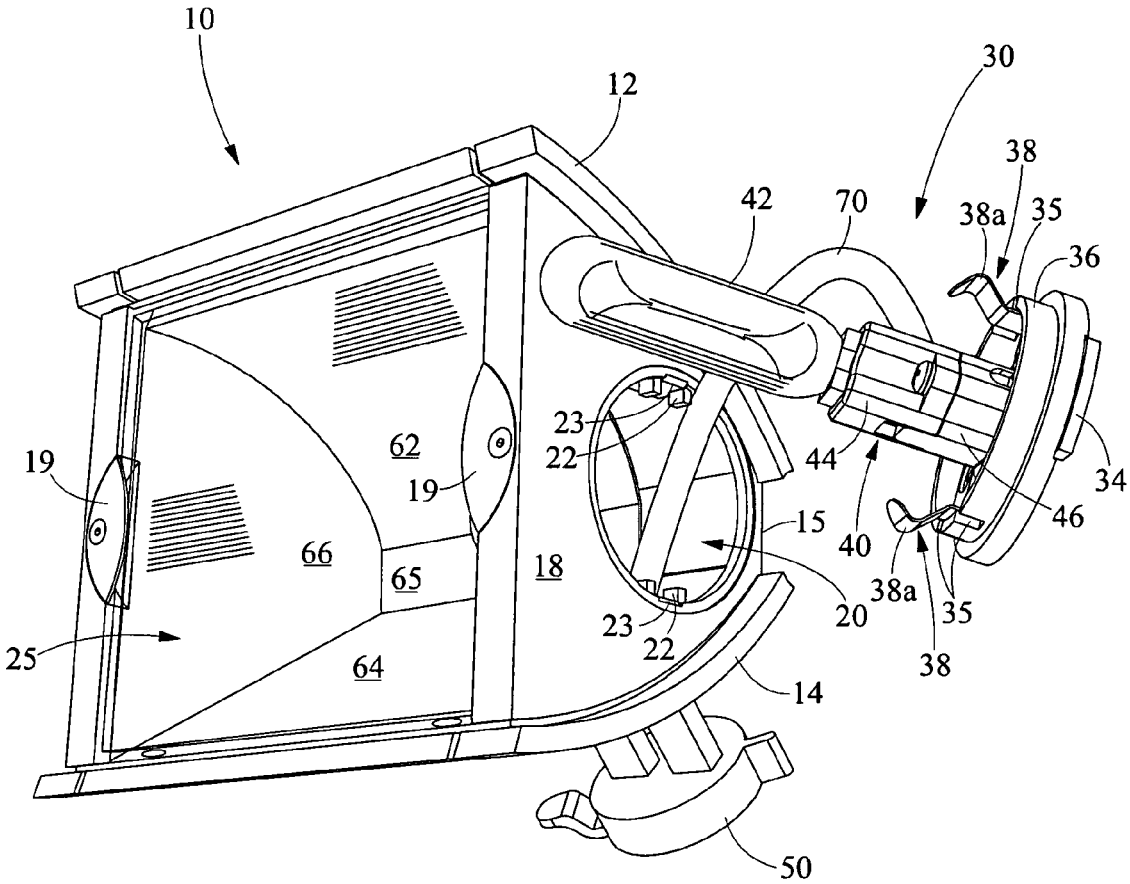
FIG. 2 is a perspective view of the side-entry lamping fixture of FIG. 1 with a lamping cartridge removed.
Figure 3:
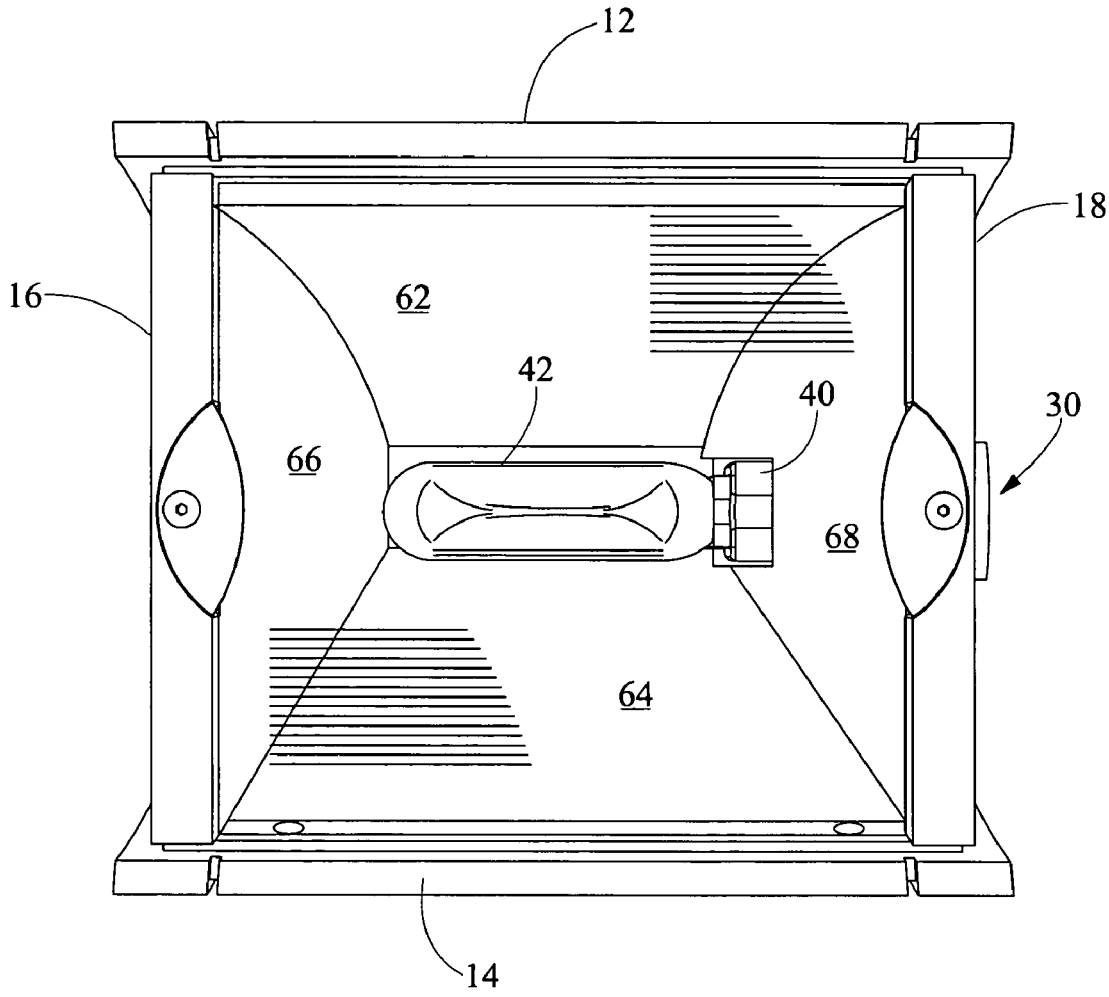
FIG. 3 a front view of the side-entry lamping fixture of the present invention; and, FIG. 4 is an inside perspective view of one sidewall of the fixture of FIG. 1 including a re-lamping aperture.

With reference now to FIGS. 1–3, within the interior portion of the side-entry lamping fixture 10 is a reflector 60 comprising an upper reflector 62, a lower reflector 64 and substantially opposed sidewall reflectors 66, 68. In order to obtain optimal wall wash optics, the upper reflector 62 is curved or concave limiting the upward direction or casting of light. The lower reflector 64 is substantially flat and angled from a vertical reflector surface 65 connecting the upper and lower reflector 62, 64 in order to provide a broader casting of light than the concave reflector which provides the wall wash. Further, the sidewall reflectors 66, 68 are not parallel as side walls 16, 18, but instead, are slightly angled outward from rear to front in order to provide a wide cast of light and optimal optics for the wall wash function. While a wall wash reflector is shown and described, the reflector 60 may be adjusted to provide a desired or optimal optics for double wall wash, corner wash or other configuration know to one of ordinary skill. Although the present design utilizes a reflector system 60, it is well within the scope of the present invention that the inner fixture walls 12, 14, 16, 18 could be painted or otherwise coated with a reflective surface to provide the optimal optics obtained with a reflector system.

Referring now to FIGS. 1 and 2, the second side wall 18 comprises a re-lamping aperture 20 allowing passage of the lamping cartridge 30 there-through in order to position the lamp or arc tube 42 at the focal point of the reflector 60.

Figure 4:
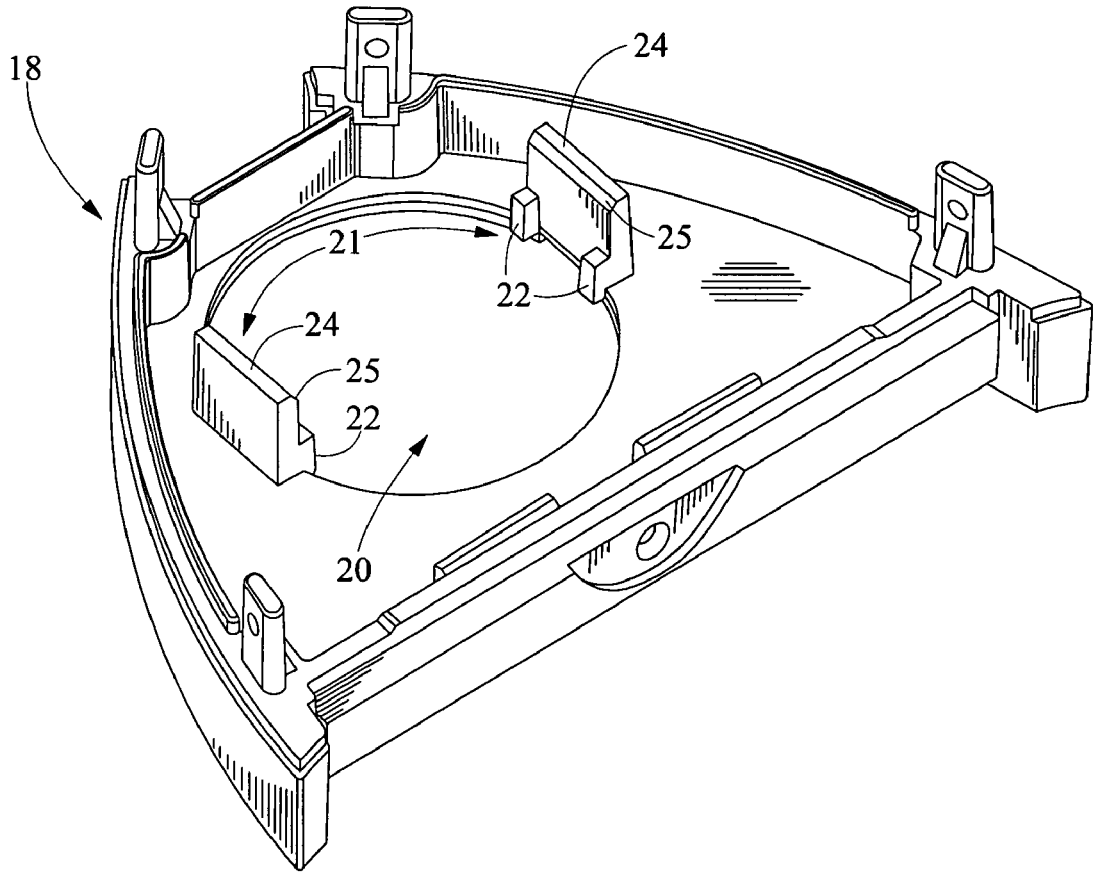

Referring now to FIGS. 2 and 4, along the inner surface of the re-lamping aperture 20 are opposed cartridge latches 21 which function to guide and retain a lamping cartridge 30 into position within the fixture 10. The cartridge latches 21 also function to properly align and orient the lamping cartridge 30 during insertion and removal from the fixture 10. The cartridge latches 21 extend inwardly to the fixture 10 from and substantially perpendicular to the second side wall 18. According to the present illustrative body, each cartridge latch 21 comprises two alignment bosses 22 spaced apart a preselected distance and defining a path of ingress and egress. As seen in FIG. 2, the front edge of each cartridge latch 21 may have a tapered surface to ease entry of a spring or fastening portion 38 into the cartridge latch 21 and between the alignment bosses 22.

As best depicted in FIG. 4, the cartridge latches 21 each comprise an engagement flange 24 extending from the inner surface of the second sidewall 18 and forming a sliding surface between the alignment bosses 22. As depicted, the inner most portion of each engagement flange 24 may include a beveled edge 25 in order to aid in removal of the lamping cartridge 30 from the fixture 10. The beveled edge 25 may also aid in the engagement between the spring 38 and the engagement flange 24 as the lamping cartridge 30 is positioned within the fixture 10.

As previously discussed, side mount lamp fixtures are limited by insufficient space for removal and installation of lamps due to lack of linear clearance for a lamp and pin between the lamp socket and opposite reflector or fixture sidewall. This results in broken lamp socket pins during installation and re-lamping. Further, the lamps can strike the fixture wall or reflector scratching the reflective surface or breaking the lamp.

Referring now to FIGS. 1–2, the lamping cartridge 30 is shown in both an installed position and an uninstalled or removed position, respectively. The lamping cartridge 30 functions to allow a means for removal and installation of a lamp or arc tube outside the fixture 10 in order to ease installation or reinstallation of the lamp 42 as well as inhibiting breakage of the lamp or contact between the lamp and the reflector during removal or installation of the lamp 42 from a socket 40. The lamp cartridge 30 comprises a cover 32 which encloses the fixture by covering the re-lamping aperture 20. The cover 32 is substantially circular in shape having an outer surface and an inner surface. The cover 32 is slightly larger in diameter than the re-lamping aperture 20 in order to completely cover the re-lamping aperture 20 inhibiting contaminants from entering the fixture 10. The cover 32 includes opposed finger tabs 34 for gripping by a user during installation and removal of the lamping cartridge 30. The finger tabs 34 are slightly raised from the outer surface of the cover 32 in order to provide a space between the tabs 34 and the second sidewall 18 for positioning of fingers during removal or installation of the lamping cartridge 30. Extending inwardly from the inner surface of the cover 32 is a collar 36 which comprises a diameter slightly smaller than the diameter of the re-lamping aperture 20 so as to extend inwardly through the re-lamping aperture 2 into the fixture 10. The collar 36 further comprises slots 35 which are in a spaced relationship so as so receive each of the alignment bosses 22. Spaced between the slots 35 and extending from the inner surface of the cover 32 are latching springs 38, are diametrically opposed on the cover 32 and positioned between the slots 35 in order to be aligned with each cartridge latch 21. The springs 38 each have a bent portion 38*a* spaced apart a distance greater than the distance between the opposed engagement flanges 24, shown in FIG. 4. The latching springs 38 are formed of a thin metal so as to flex radially inward relative to the re-lamping aperture 20 upon engagement of the cartridge latches 21 and flex radially outwardly upon reaching the beveled edge 25 during installation.

Extending from the inner surface of the cover 32 is a socket 40 for providing electrical communication to the lamp or arc tube 42. The lamp or arc-tube may be a high intensity discharge such as a T4 or a T6 metal halide lamp having at least one pin extending from the lamp for connection with the socket. More specifically, the at least one pin may be two pins which are inserted into lamp pin apertures in a socket base 46. However, other light sources may be utilized within the scope of the present invention having alternative connections. The socket 40 comprises the base 46 and an upper pin shroud 44 integral with the base 46. The pin shroud 44 inhibits electrical contact with the pins of the lamp 42 during removal or installation and thereby inhibits shock. The reflector 68 positioned along the second sidewall 18 has a cut-away portion allowing the socket 60 to pass there through.

Referring now to FIG. 2, the side-entry lamping fixture 10 further comprises an electrical cable 70 providing electrical communication between a ballast (not shown) and the socket 40. The ballast provides power for the lamp and may be mounted on or adjacent the track system from which the track lighting fixture 10 of the present invention depends.

Extending from the fixture 10 is at least one post 52. The post 52 may be pivotally connected to the side-entry lamping fixture 10 in order to provide adjustment for the angle and amount of wall wash provided by the side-entry lamping fixture 10. Such pivotal connection (not shown) may be formed by hinge or ball and socket type connection. At a distal end of the post 52 there may be a track head 50 providing an electrical connection between the fixture 10 and a track (not shown) of a track lighting system. The track head 50 engages the track in order to provide slidable engagement between the side-entry lamping fixture 10 and the track system. In addition, the track head 50 may also provide an electrical connection for the socket 40 and lamp 42.

The front edges of the first and second side walls 16, 18, each comprise lens fasteners 19 in order to retain the lens 25 in place when the side-entry lamping fixture 10 is fully constructed. The lens fastener 19 comprises opposed slots which receive peripheral edges of the lens 25 and a fastener such as a countersunk screw which engages the lens 25 in order to inhibit the lens 25 from moving within the bounds of the first and second side walls 16, 20, and the upper and lower curvilinear walls 12, 14. The lens 25 is a safety feature which inhibits broken glass of the lamp 42 from falling from the track lighting fixture 10 and injuring those below.

During initial installation or re-lamping, the cartridge 30 is removed from the fixture 10 by pulling on the finger tabs 34. As the removal force is applied, the latching springs 38 engage the beveled edge 25. More specifically, the outermost bent portion 38*a* of the spring 38 deflects inwardly and moves on to the inner surface of the engagement flange 24 between the alignment bosses 22. Once the cartridge 30 is fully removed from the fixture 10, the bi-pin lamp or arc tube 42 is inserted into the socket 40 providing an electrical connection for the lamp 42. In the case of a re-lamping procedure, the old lamp 42 is removed by pulling the lamp from the socket and disengaging the connection between the socket and the at least one lamp pin. Next a new lamp 42 is inserted into the socket 40 as previously described.

After connection is formed between the lamping cartridge 30 and the socket 40, the lamp is inserted through the re-lamping aperture 20 and each of the latching springs 38 are aligned between the alignment bosses 22. A force is applied to the finger tabs 34 or the cover 32 so that the latching springs 38 flex and pass over the beveled edge 23 onto the cartridge latches 21. Continued force moves the springs 38 along the inner surface of the cartridge latch 21 to the engagement flange 24 such that the bent portion 38*a* of the spring 38 flexes radially outward upon passing the beveled edge 25 inhibiting removal of cartridge 30 without substantially pulling force on the finger tabs 34.

Although the present invention has been described in terms of specific embodiments which are set forth in detail, it should be understood that this is by illustration only and the present invention is not necessarily limited thereto, since alternative embodiments not described in detail herein will become apparent to those skilled in the art in view of the disclosure. Accordingly, modifications are contemplates which can be made without departing from either the spirit or the scope of the present invention as described hereinabove.

I claim:

1. A side-entry lamping fixture and cartridge, comprising:
- a fixture having a side-entry re-lamping aperture;
- said fixture having an opening and a lens extending over said opening;
- a lamping cartridge disposed in said re-lamping aperture in a direction which is substantially parallel to a plane of said lens;
- said cartridge having a cover, a socket, and a lamp connected to said socket;
- diametrically opposed springs extending from said cover wherein said springs engage an interior of said fixture to retain said cover against said fixture and allow removal of said lamping cartridge with a single linear movement;
- said lamp cantilevered from said socket when said cartridge is disposed in said re-lamping aperture.

2. The side-entry lamping fixture and cartridge of claim 1, said cartridge being in electrical communication with a power supply.

3. The side-entry lamping fixture and cartridge of claim 1 inhibiting damage to said fixture and said lamp during re-lamping.

4. A side-entry lamping fixture and cartridge, comprising:
- a fixture comprising:
  - an upper fixture wall and a lower fixture wall;
  - first and second sidewalls joining said upper and lower fixture walls;
  - an opening in said fixture having a lens covering said opening;
  - at least one of said first and second sidewalls having a re-lamping aperture;
- a lamping cartridge, comprising:
  - a cover having a socket attached to said cover;
  - a lamp in electrical communication with said socket;
- first and second opposed springs extending from said cover and biasing said cover against said one of said first and second sidewalls;
  - said cartridge completely supporting said lamp at a single end;
  - said lamp extending through said re-lamping aperture in a direction substantially parallel to said lens;
- said lamping cartridge removable from said fixture with an outwardly directed linear force.

5. The side-entry lamping fixture of claim 4, said upper and lower fixture walls and said first and second sidewalls defining said opening in a front portion of said fixture.

6. The side-entry lamping fixture of claim 5 wherein said lens is a planar glass structure.

7. The side-entry lamping fixture of claim 5, said collar positioned within said re-lamping aperture.

8. The side-entry lamping fixture of claim 4 further comprising finger tabs disposed on said cover.

9. The side-entry lamping fixture of claim 4, further comprising a collar extending from an inward surface of said cover.

10. The side-entry lamping fixture of claim 4, further comprising alignment bosses extending radially inward from said re-lamping aperture.

11. The side-entry lamping fixture of claim 4, said opposed springs extending through said opening in said fixture.

12. The side-entry lamping fixture of claim 4 further comprising a reflector disposed on an interior of said fixture.

13. The side-entry lamping fixture of claim 12, said reflector including a passage for said lamping cartridge.

14. The side-entry lamping fixture of claim 4 further comprising a trackhead in spaced relation with said fixture.

15. A side-entry lamping fixture, comprising:
- a light fixture, comprising:
  - opposed sidewalls;
  - at least one curvilinear fixture wall abutting said opposed sidewalls;
  - a fixture opening and a lens positioned adjacent said opening;
  - one of said opposed sidewalls having a lamping aperture;
- a lamping cartridge, comprising:
  - a cover having a socket extending from said cover for receiving a lamp;
  - said cover disposed over said lamping aperture and biased against said lamping aperture by a retaining mechanism;

said lamp fully supported at a single end and cantilevered from said socket when disposed in said lamping aperture;

said lamp extending substantially parallel to said lens.

16. The side-entry lamping fixture of claim 15 further comprising alignment bosses extending radially inward from said lamping aperture.

17. The side-entry lamping fixture of claim 16 further comprising a fastening portion disposed between said alignment bosses.

18. The side-entry lamping fixture of claim 15 further comprising a lens disposed over an opening defined by peripheral edges of said curvilinear walls and said opposed sidewalls.

19. The side-entry lamping fixture of claim 15 further comprising a reflector positioned within said fixture.

20. A side-entry lamping fixture assembly, comprising:

a fixture comprising:

two curvilinear outer fixture walls;

two parallel fixture outer sidewalls abutting said curvilinear outer fixture walls;

a lens extending between said two curvilinear outer fixture walls and said two parallel fixture outer sidewalls to close said fixture;

a re-lamping aperture in one of said fixture sidewalls;

a lamping cartridge comprising:

a cover having a socket integral therewith;

a lamp in electrical communication with and cantilevered from said socket, said lamp extending parallel to a plane defined by said lens;

a fastening portion retaining said lamping cartridge within said re-lamping aperture;

said cover having opposed retaining springs biasing said cover against said one of said fixture sidewalls;

said cartridge removable from said fixture for relamping.

21. The side-entry lamping fixture assembly of claim 20, said lamp completely supported from a single end by said socket.

* * * * *